United States Patent [19]

Vessey et al.

[11] 4,267,932

[45] May 19, 1981

[54] SKYLINE LOGGING CARRIAGE

[76] Inventors: Rodney W. Vessey, 1006 South Hall, Grangeville, Id. 83530; Colin C. Rhoades, Box 34, White Bird, Id. 83554

[21] Appl. No.: 962,681

[22] Filed: Nov. 21, 1978

Related U.S. Application Data

[63] Continuation-in-part of Ser. No. 928,079, Jul. 26, 1978.

[51] Int. Cl.[3] ..... B66C 21/00

[52] U.S. Cl. ..... 212/92; 104/112; 104/173 R; 104/239; 188/65.4; 212/110; 212/116; 212/122

[58] Field of Search ..... 212/110–114, 212/86, 87, 83, 92, 97–99, 102–104, 106–108, 116, 122; 254/147, 139.1; 104/173 R, 112, 193, 238, 239; 188/65.4, 65.1

[56] References Cited

U.S. PATENT DOCUMENTS

| | | | |
|---|---|---|---|
| 486,164 | 11/1892 | Law | 212/110 |
| 598,145 | 2/1898 | Gaines | 212/110 |
| 983,772 | 2/1911 | Sain | 212/108 X |
| 1,360,475 | 11/1920 | Venable | 212/122 |

*Primary Examiner*—Stephen G. Kunin
*Assistant Examiner*—Edmond G. Rishell, Jr.
*Attorney, Agent, or Firm*—Harvey B. Jacobson

[57] ABSTRACT

A carriage is provided for guided movement along a skyline and includes guide structure for supporting a dragline for longitudinal shifting relative to the carriage. A skyline stop is provided for coaction with the carriage to limit downward movement of the carriage along the skyline and latch structure is shiftably supported from the carriage for movement between applied and released positions and is spring biased toward the applied position. The latch structure is engageable with the skyline stop to prevent upward movement of the carriage along the skyline from its lower limit position established by the stop upon movement of the latch structure to the applied position. Further, abutment structure is carried by the lower end of the dragline depending downwardly from the carriage and is engageable with the latch structure for swinging the latter to its released position. In addition, brake structure is supported from the carriage and includes an operator shiftable between applied and released positions and spring biased to the applied position. The operator and stop include coacting portions for automatically shifting the operator toward the released position from the applied position thereof upon final movement of the carriage downwardly along the skyline to its lower limit position established by the stop.

5 Claims, 6 Drawing Figures

SKYLINE LOGGING CARRIAGE

This application comprises a continuation-in-part of my co-pending U.S. application Ser. No. 928,079 filed July 26, 1978, for Logging Carriage.

BACKGROUND OF THE INVENTION

Various forms of skyline log skidding carriages have been heretofore provided. While some of these previous carriages have been provided with automatic locks for releasably locking the carriage in the desired lowermost position thereof along the associated skyline, most lock equipped carriages are subject to mechanical failures and/or are extremely heavy, complicated and expensive.

Although the logging carriage disclosed in my above-noted co-pending application comprises a mechanically simplified and lighter weight form of logging carriage and the carriage of the instant invention includes many of the structural features of the carriage disclosed in my co-pending application, the logging carriage of the instant invention is constructed in a manner to offer smoother and more reliable operation and is not dependent upon critical adjustments, in any way, for full and complete satisfactory operation.

In addition to the logging carriage disclosed in my above co-pending application, examples of other previously known forms of logging carriages including some of the general structural and operational features of the instant invention are disclosed in U.S. Pat. Nos. 982,737, 1,543,473, 1,725,325, 2,649,209, 2,790,561, 3,844,419 and 3,948,398.

SUMMARY OF THE INVENTION

The carriage of the instant invention includes a minimum number of movable parts operative in conjunction with a skyline stop and a dragline abutment and one primary moving part of the carriage comprises a simple first class lever. In addition to the first class lever, a second class lever as well as a rectilinearly shiftable operator therefor is provided. Otherwise, the carriage includes no additional major operating components.

The main object of this invention is to provide an automatically locking skyline supported logging carriage.

A further object of this invention is to provide a carriage in accordance with the preceding objects and including structure whereby sudden stresses on the carriage due to skyline operations will be cushioned.

Another important object of this invention is to provide a skyline carriage of lightweight construction and including operational features which will be durable in operation.

A further object of this invention is to provide a skyline carriage utilizing simple latching and braking mechanisms.

A final object of this invention to be specifically enumerated herein is to provide is to provide a logging carriage for a skyline in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 2, 6:
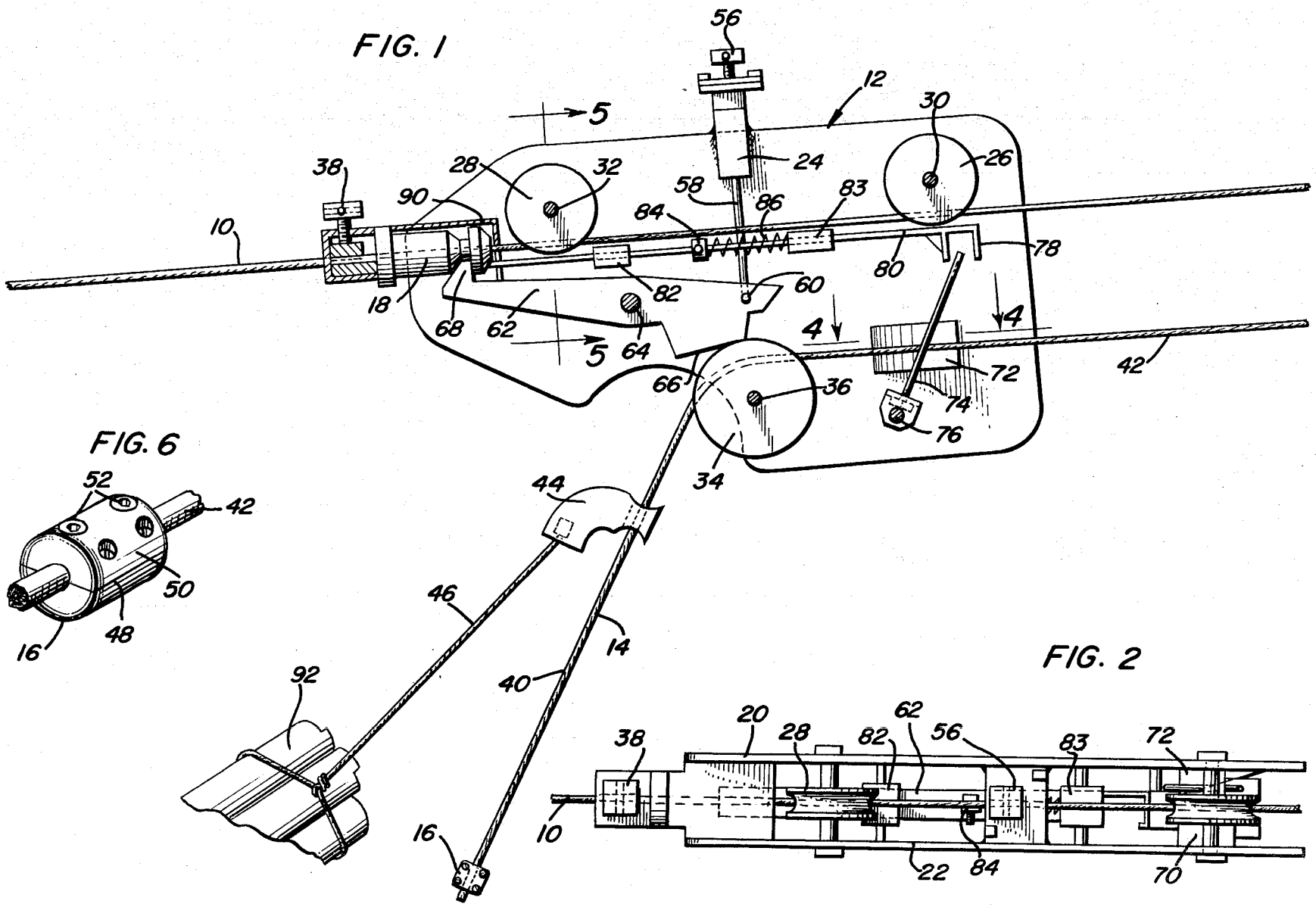
FIG. 1 is a side elevational view of the carriage of the instant invention in operative association with a skyline, a dragline, a stop mounted on the skyline and an abutment mounted on the dragline, as well as a chocker and its associated slider mounted on the lower end of the dragline, the near side place of the carriage being broken away from certain components of the carriage being illustrated in longitudinal vertical section.
FIG. 2 is a top plan view of the carriage.
FIG. 6 is a perspective view of the terminal end of the dragline and the button supported therefrom.

Referring now more specifically to the drawings, the numeral 10 designates a taught skyline, the numeral 12 generally designates a carriage constructed in accordance with the present invention, the numeral 14 designates a dragline upon which an abutment or button 16 is mounted and the reference numeral 18 designates a stop mounted in adjusted position on the skyline 10.

The carriage 12 includes a pair of opposite side plates 20 and 22 between whose upper marginal edge portions a support sleeve 24 is mounted. In addition, a pair of support pulleys 26 and 28 are journaled on axles 30 and 32 extending between corresponding front and rear end portions of the plates 20 and 22 and a guide pulley 34 is journaled on an axle 36 extending between central lower marginal portions of the plates 20 and 22.

The stop 18 includes clamp structure 38 which is adjustable and by which the stop 18 may be secured in selected position along the skyline 10 and the dragline 14 extends over the guide pulley 34, includes a depending lower end portion 40 which depends downwardly from the guide pulley 34 and an upper end portion 42 which extends upwardly along the skyline 10 forwardly of the carriage 12. Thus, the carriage 12 is basically similar to the carriage disclosed in my above-mentioned co-pending application.

A slider 44 is slidably mounted on the lower end portion 40 of the dragline 14 between the abutment or button 16 and the pulley 34 and a choker cable 46 is attached to the slider 44.

The abutment or button 16 comprises a pair of releasably interconnected half sections 48 and 50 clamped about the dragline 42 and including set screws 52 tightly frictionally engaged with the dragline 42 in order to prevent slippage of the abutment 16 relative to the dragline 42. The sleeve 24 reciprocally supports a spring biased follower (not shown) therein for up and down shifting relative to the sleeve 24 and the follower is spring biased downwardly by a compression spring (not shown) whose tension is adjustable by means of a threaded adjustment screw 56. The upper end of a push rod 58 is attached to the follower and the lower end of the push rod is pivotally attached, as at 60, to one end of a first class lever or latch 62 pivotally supported between the plates 20 and 22, as at 64. The slider 44 is engageable with a cam lug 66 carried by the aforementioned one end of the lever 62 and the other end of the lever 62 includes a hook 68 for latched engagement with the stop 18.

A guide block 70 is supported from the inner side of the plate 20 and a wedge block 72 is supported from the inner side of the plate 22 and defines a ramp surface 73 inclined. One end of a brake lever 74 is pivotally and slidably mounted on a pivot shaft 76 extending between the lower portions of the forward ends of the plates 20 and 22 and the other free end of the lever 74 is received in a downwardly opening channel 78 extending transversely between the plates 20 and 22 and carried by a longitudinally reciprocal brake operator rod 80 slidably received through a pair of guide sleeves 82 and 83 supported between the plates 20 and 22. The channel or channel member 78 is supported on the forward end of the rod 80 and the rear end of the rod 80 is engageable with the forward end of the stop, see FIG. 3. An abutment 84 is mounted on the rod 80 between the sleeves 82 and 84 and a compression spring 86 is disposed about the rod 80 between the abutment 84 and the guide sleeve 83 and thereby yieldingly biases the rod 80 from the position thereof illustrated in FIG. 1 rearwardly to the position thereof illustrated in FIG. 3 with the abutment 84 engaged with the guide sleeve 82. The abutment 84 may be adjustably shifted along rod 84 adjusting the biasing action of spring 86.

Figure 3:
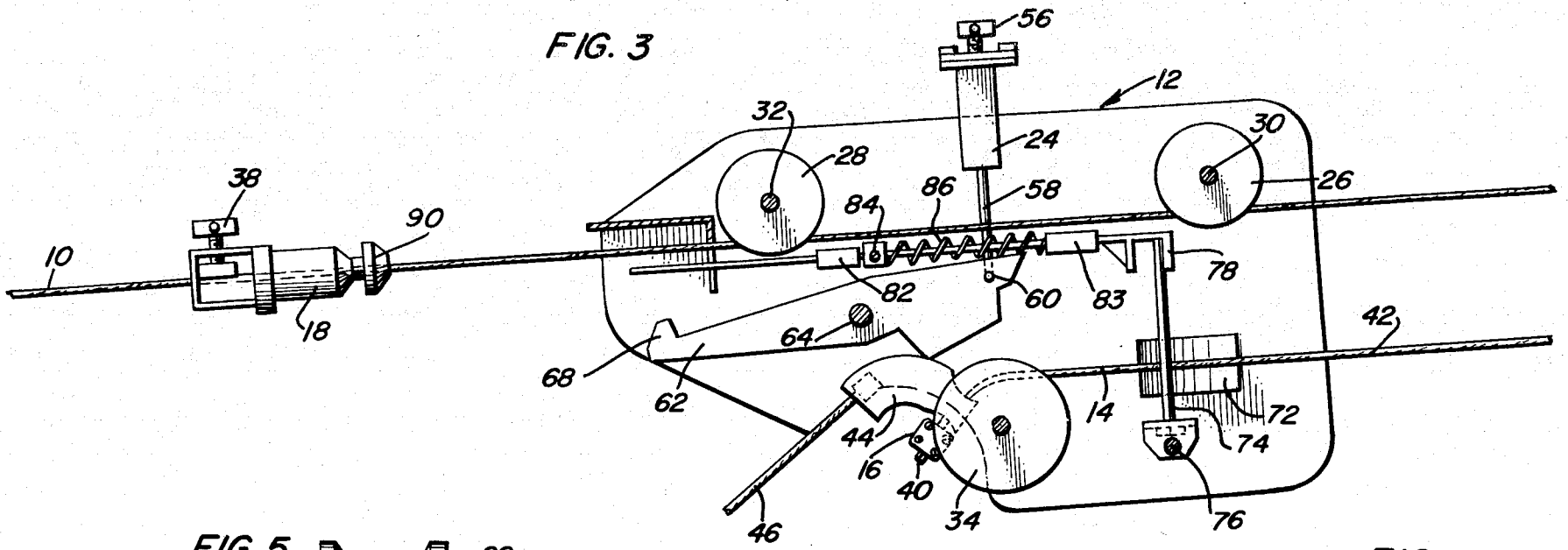
FIG. 3 is a side elevational view similar to FIG. 1 but with the latch, brake and the associated slider in different positions assumed when the dragline is being utilized to drag a load of logs upwardly along the skyline.
Figure 4:
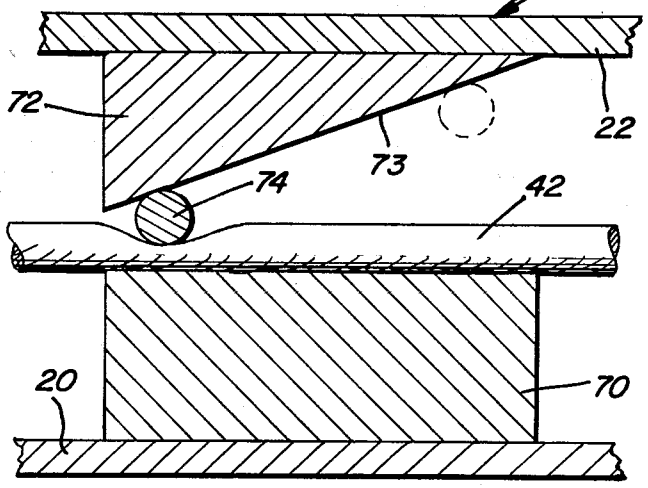
FIG. 4 is an enlarged, fragmentary, horizontal sectional view taken substantially upon the plane indicated by the section line 4—4 of FIG. 1 and with the brake lever in the applied position.
Figure 5:
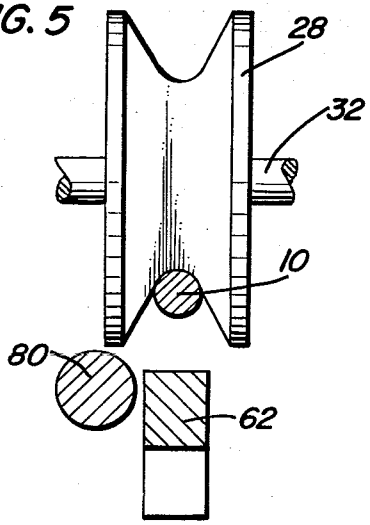
FIG. 5 is a fragmentary enlarged transverse vertical sectional view taken substantially upon the plane indicated by the section line 5—5 of FIG. 1.

In operation, the rod 80 is normally spring biased rearwardly by the compression spring 86 to the position thereof illustrated in FIG. 3 and the lever 74 thus normally assumes the position thereof illustrated in FIG. 3 with the lever 74 and the wedge block 72 acting to cam the lever 74 toward the side plate 20 and to thus clamp the dragline 42 between the lever 74 and the guide block 70. In this mode of operation, the carriage 12 is braked relative to the dragline 42 and the latter may be unreeled downwardly along the skyline 10. As the dragline 42 is unreeled downwardly along the skyline 10, the carriage 12 is moved down the skyline 10 in a controlled manner. When carriage 12 approaches the stop 18, the rear end of the rod 80 engages the forward end of the stop 18 and thus the rod 80 is shifted, against the biasing action of the spring 86, from the position thereof illustrated in FIG. 3 toward the position thereof illustrated in FIG. 1. This, of course, causes the lever 74 to be shifted from the solid line position thereof illustrated in FIG. 4 toward the phantom line position thereof illustrated in FIG. 4 and releases the dragline. At substantially the same time, the hook 68 engages the nose 90 of the stop 18 and rides over the nose 90 for engagement therebehind at substantially the same instant the carriage 12 engages the stop 18 to limit its downward movement along the skyline 10. With the hook 68 engaged behind the nose 90 of the stop 18, the carriage 12 is locked against movement upwardly along the skyline 10.

Thereafter, continued unreeling of the dragline 42 lowers the lower end 40 thereof and the abutment or button 16 to the ground whereby the choker or choker cable 46 may be engaged about a load 92 of logs. Thereafter, the dragline 42 is winched upwardly and the abutment or button 16 engages the slider 44 in order to raise the latter upwardly toward the carriage 12 while the latter is locked against upward movement along the skyline 10. As the slider 40 engages the cam lug 66 of the lever 62, the lever 62 is pivoted from the latched position thereof illustrated in FIG. 1 to the released position thereof illustrated in FIG. 3 and the hook 68 of the lever 62 is swung out from a position behind the nose 90 of the stop 18. As soon as the latch lever 62 is pivoted to its release position illustrated in FIG. 3 of the drawings, the carriage 12 shifts forwardly along the skyline 10 and relative to the dragline 42. However, initial upward movement of the carriage 12 along the skyline 10 moves the rod 80 out of engagement with the stop 18 and the rod 80 may thus return, under the biasing action of the spring 86, from the position thereof illustrated in FIG. 1 to the position thereof illustrated in FIG. 3 in order to return the lever 74 to the brake applying position thereof illustrated in FIGS. 3 and 4. Thus, the carriage 12 is braked relative to the dragline 42 and freed from latched engagement with the stop 18 and the carriage 12 may move further upwardly along the skyline 10 as the dragline 42 is reeled in. This, of course, causes the load 92 of logs to be dragged upwardly toward the upper end of the skyline 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an inclined skyline, a carriage guidingly supported from said skyline for movement therealong, a stop carried by said skyline establishing a lower limit of downward movement of said carriage along said skyline, said carriage including guide means, a dragline guidingly supported from said guide means for longitudinal shifting relative to said carriage and including one end portion depending downwardly from said carriage and a second end portion extending upwardly along said skyline, an abutment means carried by said one end portion of said dragline for abuttingly engaging with said carriage for limiting upward movement of said dragline relative to said carriage, latch means shiftably supported from said carriage for movement between first and second applied and release positions and spring biased toward its applied position, said latch means being latchingly engageable with said stop to latch said carriage against upward movement of said carriage when said latch means is in said first position and said carriage is in its lower limit position on said skyline defined by said stop, brake means on said carriage including an operator shiftable between applied and released positions and spring biased to its applied position, said brake means being operative to brake the second end portion of said dragline against longitudinal shifting relative to said carriage when said operator is in its applied position, said abutment means, upon upward movement of said one end portion of said dragline relative to said carriage into a predetermined raised position including means operative to shift said latch means from its applied position to its release position, said stop and operator including means operative to positively shift said operator toward its released position upon final movement of said carriage downwardly along said skyline toward said lower limit, said carriage including opposite side portions between which said dragline is guidingly received, an abutment surface carried by one side portion, generally paralleling said second end portion of said dragline, facing the other side portion of said carriage and closely opposing the side of said dragline adjacent said one side portion of said carriage, pivot means defining a pivot axis extending between said opposite side portions, said brake means including a wedge member supported from said other side portion of said carriage opposing said abutment surface and defining a ramp surface inclined downwardly along said dragline second end portion toward said one side portion of said carriage, said brake means also including a lever pivotally supported at one end portion from said carriage by said pivot means for oscillation about said axis with the latter extending transversely of said lever and with the remaining portion of said lever disposed between said abutment and ramp surfaces, said lever being supported from said pivot means for lateral shifting along said axis, said operator being operably associated with the remaining portion of said lever for swinging said remaining portion downwardly along said dragline responsive to shifting of said operator to said applied position and for swinging said remaining portion of said lever upwardly along said dragline responsive to shifting of said operator to said released position, said lever, when being swung downwardly along said dragline being engageable with said ramp surface to effect camming of said lever along said axis toward said abutment surface and into engagement with said dragline for clampingly engaging the dragline between said remaining portion of said lever abutment surface.

2. The combination of claim 1 wherein said latch means comprises a single cam lever, only, oscillatably supported from said carriage.

3. The combination of claim 2 wherein said cam lever comprises a first class lever.

4. The combination of claim 1 wherein said carriage includes means operative to adjust the biasing action upon said latch means urging the latter toward its applied position.

5. The combination of claim 1 wherein said operator includes means operative to adjust the spring biasing action thereagainst urging the operator toward its applied position.

* * * * *